US005366399A

United States Patent [19]

Reid et al.

[11] Patent Number: 5,366,399

[45] Date of Patent: Nov. 22, 1994

[54] MARINE STERN DRIVE WITH LUBRICATED AND SEMI-SEALED ENGINE OUTPUT COUPLER

[75] Inventors: Raymond Reid; Edward C. Eick, both of Stillwater, Okla.

[73] Assignee: Brunswick Corporation, Lake Forest, Ill.

[21] Appl. No.: 149,328

[22] Filed: Dec. 13, 1993

[51] Int. Cl.[5] ..... B63H 23/00

[52] U.S. Cl. ..... 440/83; 464/16

[58] Field of Search ..... 440/52, 62, 64, 83, 440/111, 112, 113; 464/16, 92; 403/37, 39, 359

[56] References Cited

U.S. PATENT DOCUMENTS 4,634,391 1/1987 Entringer et al. .
4,710,142 12/1987 Lovell ..... 440/83
4,904,214 2/1990 Eick .
4,913,671 4/1990 Gavriles et al. .

*Primary Examiner*—Stephen P. Avila

*Attorney, Agent, or Firm*—Andrus, Sceales, Starke & Sawall

[57] ABSTRACT

A marine stern drive has an engine output coupler driven to rotate about an axis with a hub that has an axial opening. The forward end of the axial opening is splined and the rearward end is non-splined. The axial opening receives an output driveshaft. The forward end of the driveshaft is splined and engages the splined section of the axial opening so that the engine coupler can rotatably drive the driveshaft. An O-ring seal is provided between the driveshaft and the axial opening in the non-splined section of the axial opening towards the rearward end of the axial opening. An end plug is provided in the forward end of the axial opening for plugging the forward end of the axial opening. A grease passage is provided through the engine coupler to allow grease to be introduced between the seal and the end plug and lubricate the splines. The space between the end plug and the drive plug acts as a grease reservoir. A hole is provided through the end plug to relieve grease pressure and reduce hydraulic lock.

9 Claims, 3 Drawing Sheets

FIG. 5
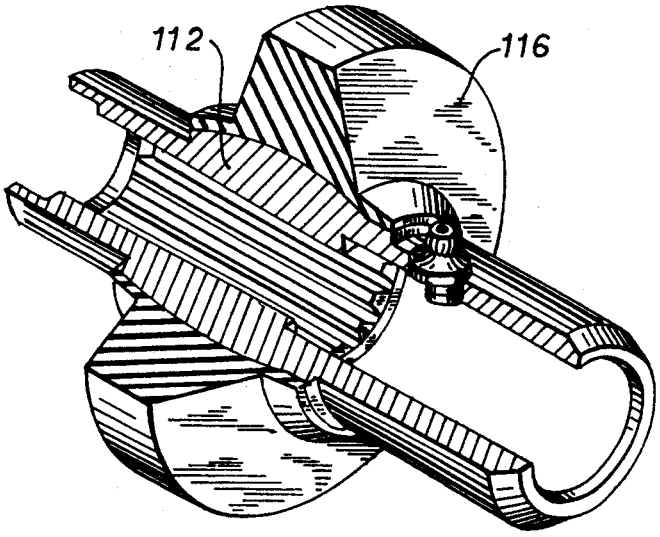
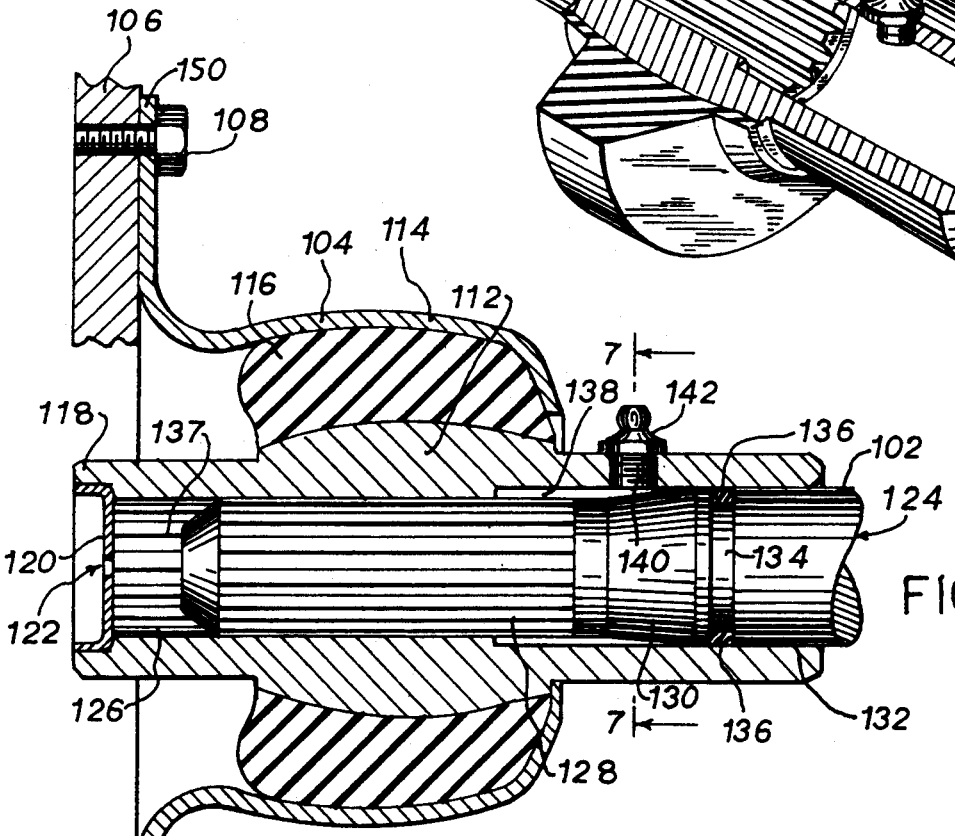
FIG. 6
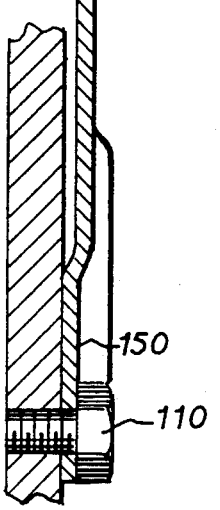
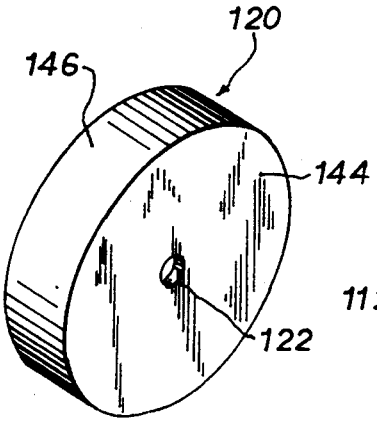
FIG. 8
FIG. 7
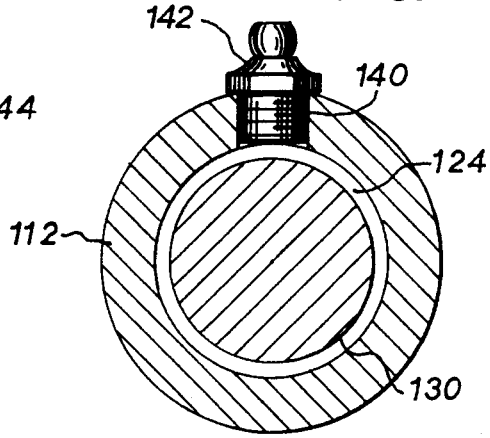

MARINE STERN DRIVE WITH LUBRICATED AND SEMI-SEALED ENGINE OUTPUT COUPLER

BACKGROUND OF THE INVENTION

An engine output coupler for a marine stern drive is used to connect an engine flywheel to an output driveshaft in the stern drive so that engine power can be transmitted to the stern drive, and eventually to a propeller. The present invention relates to lubricating the interface of the engine output coupler and the output driveshaft. In particular, the present invention relates to an engine output coupler for a marine stern drive with a semi-sealed lubrication system.

A marine stern drive has a gear case in which a vertical driveshaft drives a horizontal propeller shaft. The vertical driveshaft is driven at the top of the gear case by a universal joint. The output driveshaft, which is driven by the engine output coupler, drives the universal joint. The horizontal propeller shaft is located mostly in a lower torpedo housing. A propeller is mounted on a portion of the horizontal propeller shaft extending rearward from the torpedo housing. The horizontal propeller shaft is rotatably driven at a transmission that interfaces the bottom of the vertical driveshaft and the horizontal propeller shaft.

The output driveshaft extends into a boat through the transom of the boat and is received in the engine output coupler. The output driveshaft has a forward splined end that engages in an axial splined opening of the engine output coupler. It is important that the forward splined end of the output driveshaft can slide in the engine output coupler when the boat is steered or trimmed.

In such a marine stern drive system, spline wear can be a problem due to lack of lubrication, especially when the stern drive is operated continuously at low speeds, such as by commercial fisherman. Periodic lubrication is required to prevent premature spline wear. In U.S. Pat. No. 4,904,214, Eick discloses a system to facilitate relubrication of the splines of an engine output coupler and an output driveshaft. The system in U.S. Pat. No. 4,904,214 also provides grease traps and reservoirs to keep lubricant available to the splines for longer periods of time.

The splines of the driveshaft are normally made of steel, whereas the splines of the coupler are normally made of aluminum. Aluminum is used to battle against corrosion in case a leak develops and allows salt or brackish water to enter into the splined area. Aluminum is not as tough as steel, however, and aluminum splines can strip over time especially if the splined area is not properly lubricated. Although steel splines are tough and more resistent to wear than aluminum splines, it is not usually practical to use steel splines in the coupler because the driveshaft can lock up (i.e. not be able to slide when the boat is steered or trimmed) if the steel splines corrode.

SUMMARY OF THE INVENTION

The present invention is an engine coupler that effectively maintains lubrication of the splined area and also effectively seals water from entering the splined area. The engine coupler of the present invention can use steel splines which can resist wear better than aluminum splines. The present invention is also easier to manufacture and service.

In particular, the invention is a marine drive having an engine coupler with an axial opening that has splines around a section of the opening, an output driveshaft with a splined section that engages with the spline section of the axial opening, a seal between the driveshaft and the axial opening for sealing the splines from the rearward end of the axial opening, and an end plug for plugging the forward end of the axial opening. Preferably, the drive also includes a grease passage through the engine coupler that is located between the seal and the end plug to allow grease to be supplied into the axial opening between the seal and the end plug. It is preferred that the end plug have a hole, that the end plug be spaced in the axial opening sufficiently forward of the driveshaft so that there is a grease reservoir between the driveshaft and the end plug.

A primary object of the invention is to seal water from entering into the splined area, and thus prevent corrosion of the splined area, and maintain the integrity of lubricants.

Another object is to do the same without allowing the splined driveshaft to be hydraulically locked.

Another object is to allow lubrication to escape from the splined area when the pressure of the lubricant begins to rise.

Another object is to provide a relatively large grease reservoir.

BRIEF DESCRIPTION OF THE DRAWINGS

Prior Art

Present Invention

Figure 4:
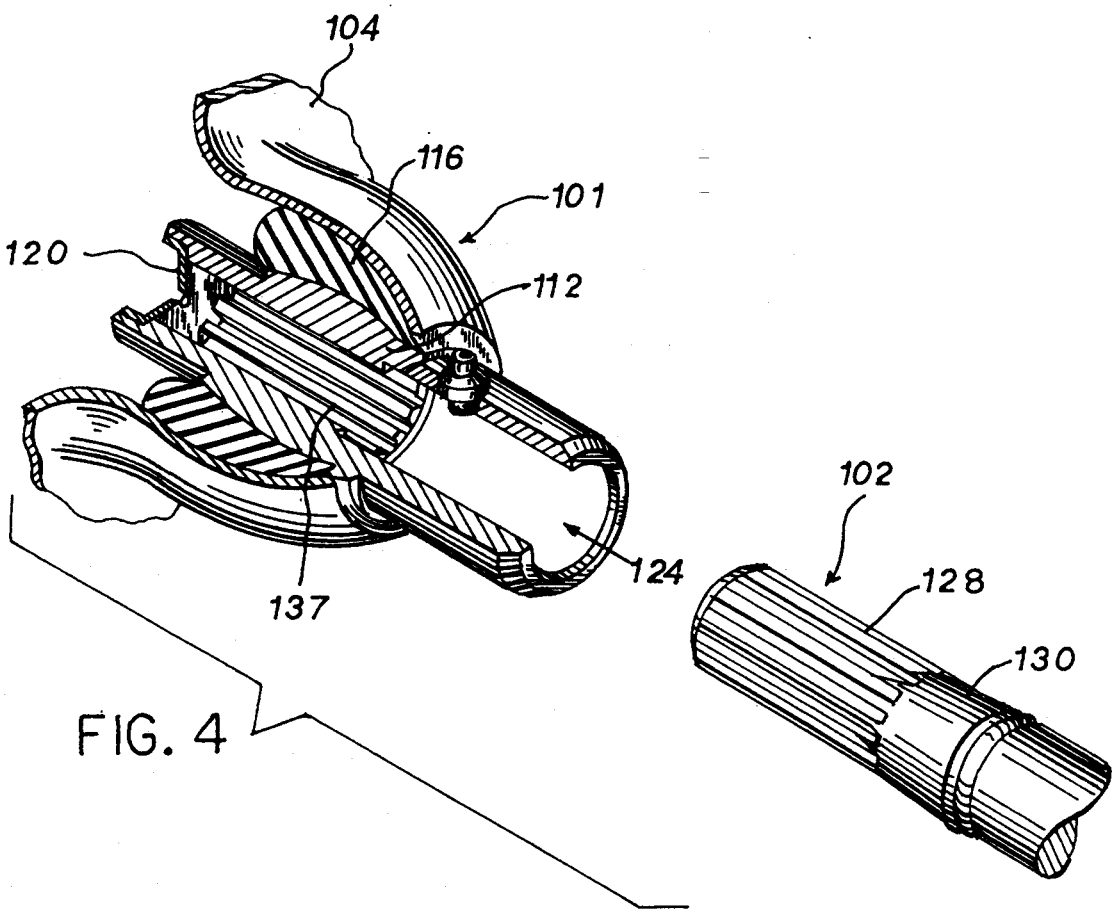

FIG. 4 is a perspective view with portions cut away, of an engine output coupler and driveshaft separated therefrom, in accordance with the present invention.

FIG. 5 is a perspective view with portions cut away of the coupler of FIG. 4.

FIG. 6 is a sectional view of the coupler and driveshaft of FIG. 4, with the driveshaft inserted in the coupler.

FIG. 7 is a sectional view taken along line 7—7 of FIG. 6.

FIG. 8 is a perspective view of an end plug that can be used in accordance with the present invention.

DETAILED DESCRIPTION OF THE PREFERRED EMBODIMENT

Prior Art

Figure 1:
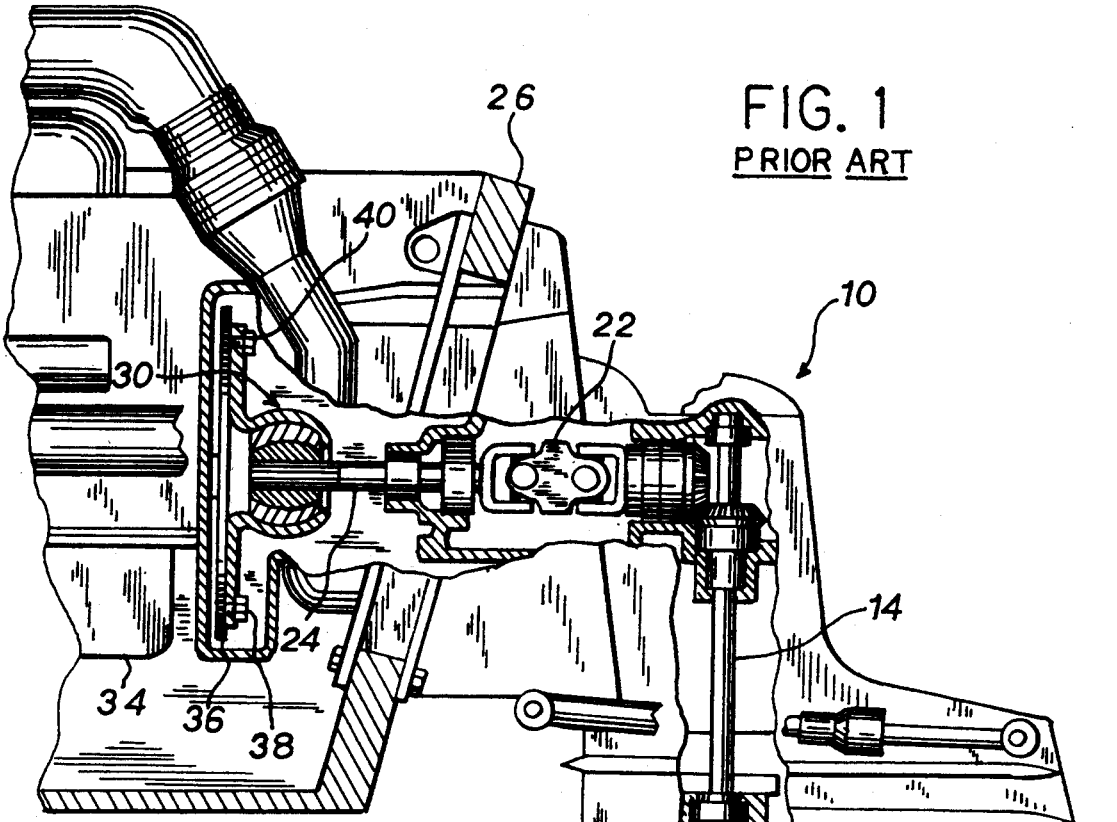
FIG. 1 PRIOR ART
FIG. 1 is a side view partially in section of a marine stern drive known in the prior art.

FIG. 1 shows a prior art marine stern drive 10. The drive 10 has a vertical driveshaft 14 in a lower outboard gear case 12 that drives a horizontal propeller shaft 16 which is located in a lower torpedo housing 18. A universal joint 22 drives the vertical driveshaft 14 at the top of the gear case 12. An output driveshaft 24 drives the universal joint 22 and extends through the transom 26 of a boat.

Figure 2:
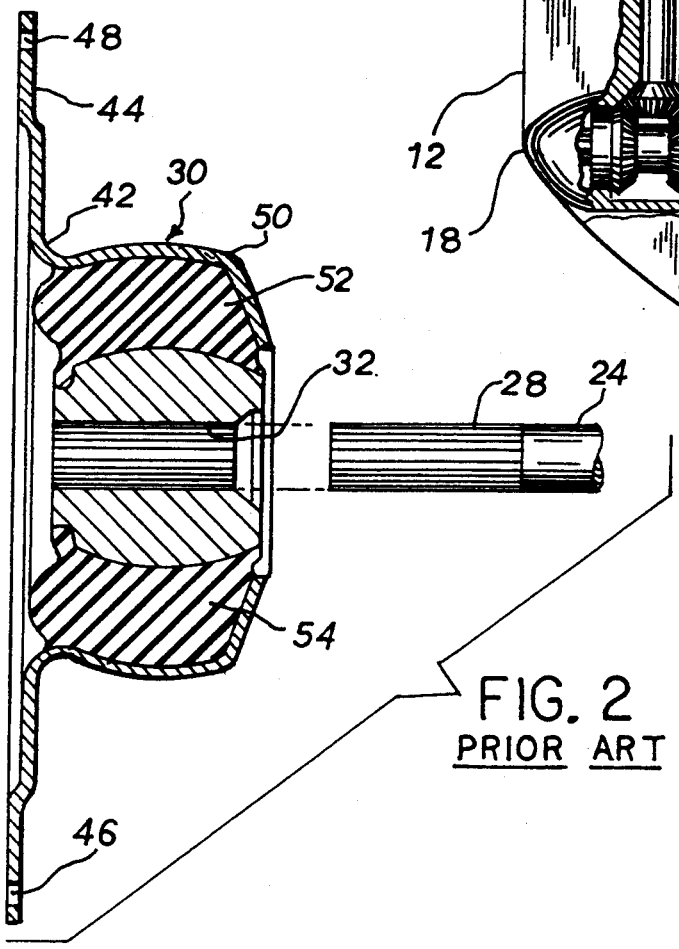
FIG. 2 PRIOR ART
FIG. 2 is an enlarged portion of FIG. 1 showing an output driveshaft separated from an engine output coupler.

As shown in FIG. 2, output driveshaft 24 has a forward axially splined end 28. An engine output coupler 30 has an axially splined opening 32 that receives the forward splined end 28 of the output driveshaft 24. Splined opening 32 is open in both the forward (left) and rearward (right) directions. Referring again to FIG. 1, a flywheel 36, that is driven by an inboard internal combustion engine 34, is connected to the coupler 30 by peripheral bolts around the circumference of the coupler 30, such as bolts 38 and 40. In operation, engine 34 rotates flywheel 36 to rotate coupler 30 to drive output driveshaft 24, to drive universal joint 22, to drive vertical driveshaft 14, to drive propeller shaft 16, to rotate propeller 20, as is standard in the art.

Referring again to FIG. 2, the coupler 30 includes an outer metal housing 42 with a peripheral circumferential flange 44. The flange 44 has apertures, such as apertures 46 and 48, spaced circumferentially to receive bolts, such as bolts 38 and 40, in order to attach the metal housing 42 to the flywheel 36 as discussed above. The housing 42 has a central raised top hat like portion 50 (extending rightwardly in FIG. 2). The central raised portion 50 receives a rubber insert 52. The shape of the rubber insert 52 is similar in a pre-deformed condition before it is inserted into the raised portion 50 of the housing 42 as the insert 116 shown in FIG. 5. Upon insertion into the top-hat portion 50 of the metal housing 42, insert 52 deforms to the shape shown in FIG. 2.

Coupler 30 also has a central metal hub 54 that embodies the axially splined opening 32 therein. In this prior art system, the coupler hub 54 is typically made of aluminum. The coupler hub 54 is snugly gripped by the rubber insert 52, and is even more tightly gripped upon deformation of the rubber insert 52 when the rubber insert 52 is inserted into the housing portion 50 as shown in FIG. 2. Rubber insert 52 allows some resilient give and shock absorbing capability.

Figure 3:
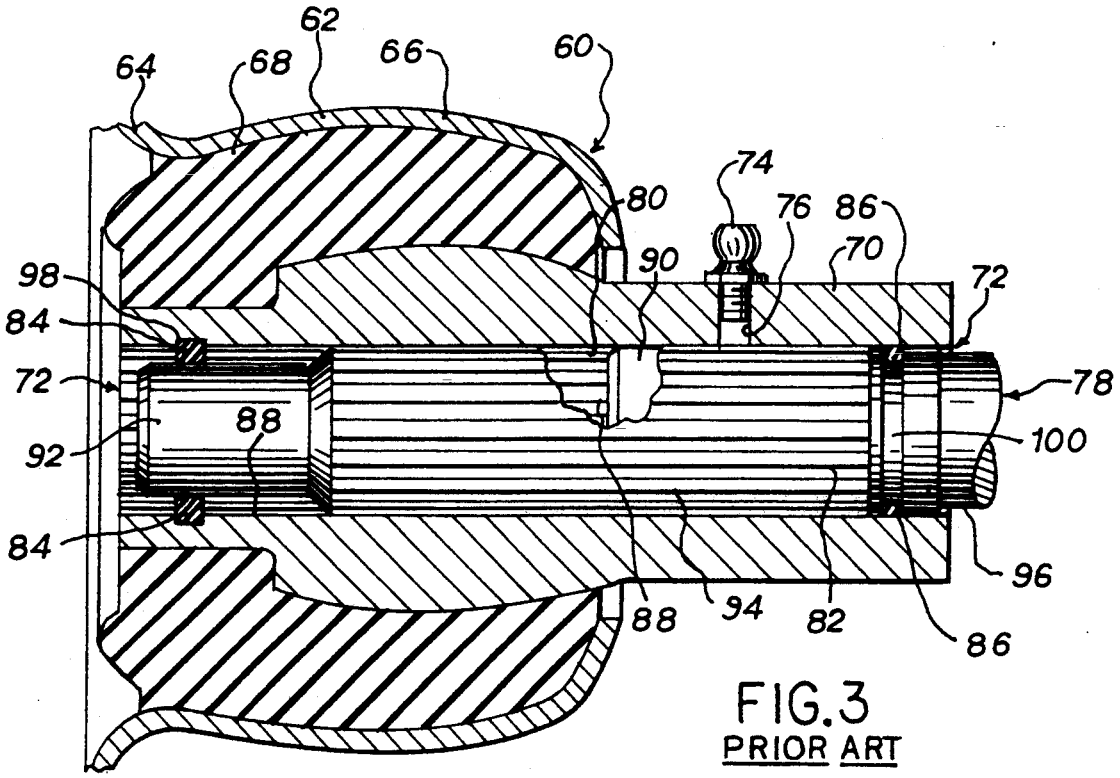
FIG.3 PRIOR ART
FIG. 3 is a sectional view of another prier art engine output coupler and driveshaft, with the driveshaft inserted into the engine output coupler.

Another prior art engine output coupler 60 is disclosed in U.S. Pat. No. 4,904,214, and is depicted in FIG. 3. U.S. Pat. No. 4,904,214 is incorporated by reference herein, and like reference numbers are used where appropriate to facilitate understanding. In FIG. 3, coupler 60 has a metal housing 62 with a peripheral circumferential flange 64 that is comparable to flange 44 shown in FIG. 2. The housing 62 has a central raised top hat like portion 66, which is similar to portion 50, but with greater height. The housing portion 66 receives a rubber insert 68. The coupler 60 also has a central metal hub 70 with an axially splined opening 72 therein. The metal hub 70, in this prior art system, is typically made of aluminum. The opening 72 is open in both the forward (left) and rearward (right) directions. The hub 70 is snugly gripped by the rubber insert 68 prior to insertion of the insert 68 into the housing portion 66, and is more tightly gripped upon deformation of the rubber insert 66 after the insert 68 is inserted into the housing portion 66. After the insert 68 and the hub 70 are inserted into the housing 62, a grease fitting 74 is threaded into a radial bore 76 in the hub 70. A splined output driveshaft 78 is received in the splined axial opening 72 of the coupler 60.

The splined opening 72 in hub 70 has a forward splined section 88 and a rearward non-splined section 90. Driveshaft 78 has a forward non-splined section 92, a splined section 94 rearward of the forward splined section 92, and another non-splined section 96 rearward of the splined section 94. The driveshaft 78 is received in the hub opening 72 in such a manner that the splined section 94 of the driveshaft 78 and the splined section 88 of the hub opening 72 partially overlap and are in mating driving engagement. The forward non-splined section 92 of the driveshaft 78 is received in a portion of the splined section 88 of the hub opening 72 forward of the overlapping splined sections. There is a portion of the splined section 94 of the driveshaft 72 located rearward of the overlapping spline sections that is received in the non-splined section 90 of the hub opening 72. The non-splined section 96 of the driveshaft 72 that is located rearward of the spline section 94 is also received in the non-splined section 90 of the hub opening 72.

Grease is introduced into the coupler 60 at the grease fitting 74. The grease passage 76 communicates with the splines 80 of the coupler 60 and 82 of the output driveshaft 78 to lubricate the splines 80 and 82. A front O-ring 84 and a rear O-ring 86 are axially spaced along the driveshaft 78 within the hub 70. The 0-rings 84 and 86 serve to trap and retain grease therebetween and to maintain lubrication of the overlapping splines 80 and 82.

The front seal provided by O-ring 84 is located at the interface of the forward non-splined section 92 of the driveshaft 72 and the forward splined section 88 of the hub opening 72. The rear seal provided by O-ring 86 is located at the interface of the non-splined rearward section 96 of the driveshaft 78 and the non-splined rearward section 90 of the hub opening 72 at a position rearward of the spline section 94 of the driveshaft 78.

The forward splined section 88 of the hub opening 72 has an annular notch 98 extending therearound perpendicularly through the splines 80 and spaced axially forward of the overlapping splined sections. The O-ring 84 is located in the notch 98 and encircles the forward non-splined section 92 of the driveshaft 78. The O-ring 84 has a thickness greater than the spline depth such that the inner periphery of the O-ring 84 extends radially inward beyond the inner periphery of the teeth or splines 80 of the forward splined section 88 of the hub opening 72.

The non-splined section 96 of the driveshaft 78, which is located rearward of the spline section 94, has an annular notch 100. The O-ring 86 is located in the notch 100 and engages the non-splined rearward section 90 of the hub opening 72.

In this manner, the O-rings 84 and 86 trap and retain grease therebetween to maintain lubrication of the splines. A reservoir is also provided at the forward non-splined driveshaft section 92 rearward of seal 84, and another reservoir is located at the rearward non-splined hub opening section 90 forward of the seal 86. In addition, the hub spline length and the shaft spline length as overlapped, and as extending along non-splined sections of each other, enable the trim and steering operations which are necessary in a marine drive.

Present Invention

Referring to FIGS. 4–8, the preferred embodiment of the present invention includes an engine output coupler 101 and a driveshaft 102 structured to form a semi-sealed lubrication system. In particular, an end plug 120, preferably with a hole 122, is located in a forward portion 118 of a hub opening 124 of the coupler 101. By using an end plug 120, the forward O-ring 84 shown in FIG. 3 can be eliminated. Also, the forward non-splined portion 92 of the driveshaft 78 shown in FIG. 3 can be eliminated. In addition, the present invention enables the use of a relatively large lubricant reservoir 126 as can be seen best in FIG. 6. The hole 122 through the end plug 120 also keeps grease pressure from increasing too high, and also reduces hydraulic lock, when the boat is steered or trimmed.

Referring in particular to FIGS. 4 and 6, the coupler 101 has an outer metal housing 104, a rubber insert 116 and an annular hub 112. The outer metal housing 104 is attached to a flywheel 106 using bolts, such as bolts 108 and 110 as in the prior art. Referring to FIG. 5, the rubber insert 116 is fit snugly around the hub 112 in a non-deformed state. Referring again to FIGS. 4 and 6, the rubber insert 116 deforms when the rubber insert 116 and the hub 112 are inserted within the outer metal housing 104. The rubber insert 116 grips the hub 112 tighter when the hub 112 and the insert 116 are inserted into the housing 104 and the insert 116 is deformed. The rubber insert 116 also grips the outer metal housing 104. As so constructed, the coupler 101 rotates when an internal combustion engine rotates the flywheel 106.

The coupler 101 is used to drive the driveshaft 102. The driveshaft 102 has a forward splined section 128, a non-splined tapered portion 130 located rearward from the forward splined section 128, and a straight non-splined portion 132 located rearward of the tapered position 130. The driveshaft 102 is easier to manufacture because it does not include a forward non-splined section. The straight non-splined section 132 has an annular notch 134 therein. An O-ring 136 is located in the annular notch 134.

The coupler hub 112 has an internal passage or axial opening 124 located along that axis of the hub 112. The axial opening 124 of the hub 112 has a forward splined section 137 and a rearward non-splined section 138. A grease passage 140 is bored through the coupler hub 112 at the rearward non-splined section 138 of the hub 112. A grease fitting 142 is threaded into the passage 140, and can be used to supply grease into the axial opening 124 of the hub 112. The O-ring 136 located in notch 134 of the driveshaft 102 engages the inside surface of the rearward non-splined section 138 of the axial opening 124 of the hub 112. The seal 136 prevents water from entering into the splined region, and keeps grease from blowing out along the driveshaft 102. With the O-ring 136 located in notch 134 on the driveshaft 102, someone installing the driveshaft 102 into the coupler 101 can easily notice the O-ring 136 if the O-ring 136 is forced out of notch 134 while installing the driveshaft 102 in the coupler 101.

As shown in FIG. 6, the rearward non-splined section 138 of the axial opening 124 of the hub 112 has a larger diameter than the diameter of the forward splined section 137. In order to accommodate this change in diameter, the driveshaft 102 has a tapered non-splined portion 130. It is not necessary for the invention that the diameter of the axial passage 124 in the rearward non-splined section 138 be larger than the axial passage in the forward spline section 137.

The forward splined section 128 of the driveshaft 102 engages the forward splined section 137 in the axial opening 124 of the hub 112, in mating drive engagement. The engagement of the spline section 128 of the driveshaft 102 into the spline section 137 of the hub 112 is such that the driveshaft 102 can slide axially relative to the metal hub 112 which may be necessary when the boat is steered or trimmed.

The hub 112 is extended at 118 in the forward direction beyond the splined section 137. The axial opening 124 in the forward extension 118 has a diameter slightly larger than the diameter in the splined section 137. The axial opening 124 in the forward extension 118 is not splined, and receives an end plug 120. The end plug is shown in detail in FIG. 8.

As shown in FIG. 8, the end plug 120 has a circular-shaped front wall 144 and a cylindrical side wall 146 extending perpendicularly from the periphery of the circular shaped wall 144. The hole 122 passes through the circular-shaped wall 144. The plug 120 can be press fit into the axial opening at the forward extension 118. A grease reservoir 126 is formed between the end plug 120 and the driveshaft 102. The hole 122 allows grease to escape when pressure within the reservoir 126 increases. The hole 122 makes it less likely for the plug 120 to blow out when the grease pressure in reservoir 126 increases. The hole 122 also reduces hydraulic lock from occurring when the driveshaft 102 slides rearward relative to the coupler 101.

As is evident from the drawings, the present invention can be made with a relatively large grease reservoir 126. It is preferred that the extension 118 be extended forward beyond the flange 150 to allow for a large grease reservoir 126. The relatively large grease reservoir 126 allows the required time between relubricating the splines to be increased. As such, the present invention reduces servicing requirements, cost and down time for boat operators. In addition, the present invention eliminates the need for a forward O-ring. And as mentioned above, proper installation of the driveshaft 102 can also be easier because only one O-ring is used, and the design is such that the rearward O-ring 136 will become visible if the O-ring 136 is forced out of the annular notch 134 on the driveshaft 102.

With present marine drives, it is preferred that the splines of coupler hub 112 and of the driveshaft 102 be made of steel, rather than aluminum. Steel is tougher against wear and thus resists spline wear better than other material such as aluminum. In addition, some types of steel are actually self-lubricating to some extent.

It is recognized that various equivalents, alternatives and modifications are possible and should be considered to be within the scope of the claims.

We claim:

1. A marine drive comprising:

an engine output coupler driven to rotate about an axis, the engine coupler having an axial opening therein extending along the axis, wherein a section of the axial opening is splined and the axial opening has a forward end and a rearward end;

an output driveshaft that is received through the rearward end of the axial opening of the engine coupler, the output driveshaft having a splined section that engages with the splined section of the axial opening in such a manner that the driveshaft can slide axially relative to the engine coupler and also be rotated by the engine coupler when the engine coupler is driven to rotate;

a seal between the driveshaft and the axial opening for sealing the spline sections from the rearward end of the axial opening; and an end plug for plugging the forward end of the axial opening.

2. A marine drive as recited in claim 1 wherein the engine coupler further has a grease passage there through that leads into the axial opening so that grease can be supplied into the axial opening between the seal and the end plug.

3. A marine drive as recited in claim 2 further comprising a grease nipple communicating with the grease passage.

4. A marine drive as recited in claim 1 wherein the end plug is spaced sufficiently forward of the driveshaft so that a grease reservoir exists therebetween.

5. A marine drive as recited in claim 1 wherein the end plug has a hole therein.

6. A marine drive as recited in claim 1, wherein:

a non-splined section of the driveshaft is located rearward of the splined section of the driveshaft and has an annular notch therein;

the seal is an O-ring located in the annular notch on the driveshaft; and the O-ring engages a non-splined section of the axial opening in the engine output coupler rearward of the splined section of the axial opening.

7. A marine drive as recited in claim 5 wherein the engine coupler has a metal housing with a flanged periphery that is attached to a flywheel to drive the engine output coupler to rotate, and the axial opening of the engine output coupler is extended forward beyond the location of the flanged periphery.

8. A marine drive as recited in claim 1 wherein the splines on the driveshaft and the splines in the axial opening of the engine output coupler are steel.

9. A marine drive as recited in claim 1 wherein the end plug is press fit into the forward end of the axial opening of the engine output coupler.

* * * * *